US009150812B2

(12) United States Patent
Cooper et al.

(10) Patent No.: US 9,150,812 B2
(45) Date of Patent: Oct. 6, 2015

(54) ANTIOXIDANT COMBINATION AND SYNTHETIC BASE OILS CONTAINING THE SAME

(71) Applicants: Kathleen Kim Cooper, South River, NJ (US); Angela S. Galiano-Roth, Mullica Hill, NJ (US); David Alan Blain, Cherry Hill, NJ (US); Eugenio Sanchez, Pitman, NJ (US); Nilka Yajaira Leon, Woodbury, NJ (US); James T. Carey, Medford, NJ (US); Oleg Yurievich Melnichenko, Cherry Hill, NJ (US)

(72) Inventors: Kathleen Kim Cooper, South River, NJ (US); Angela S. Galiano-Roth, Mullica Hill, NJ (US); David Alan Blain, Cherry Hill, NJ (US); Eugenio Sanchez, Pitman, NJ (US); Nilka Yajaira Leon, Woodbury, NJ (US); James T. Carey, Medford, NJ (US); Oleg Yurievich Melnichenko, Cherry Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 14 days.

(21) Appl. No.: 13/790,799

(22) Filed: Mar. 8, 2013

(65) Prior Publication Data

US 2013/0252863 A1 Sep. 26, 2013

Related U.S. Application Data

(60) Provisional application No. 61/614,223, filed on Mar. 22, 2012.

(51) Int. Cl.

| | |
|---|---|
| ***C10M 169/04*** | (2006.01) |
| ***C10M 141/08*** | (2006.01) |
| *C10M 133/54* | (2006.01) |
| *C10M 133/22* | (2006.01) |
| *C10M 133/04* | (2006.01) |
| *C10M 133/28* | (2006.01) |
| *C10M 135/18* | (2006.01) |
| *C10M 107/02* | (2006.01) |
| *C10M 135/36* | (2006.01) |
| *C10M 133/58* | (2006.01) |
| *C10M 105/06* | (2006.01) |

(52) U.S. Cl.

CPC ..... *C10M 141/08* (2013.01); *C10M 169/04* (2013.01); *C10M 105/06* (2013.01); *C10M 107/02* (2013.01); *C10M 133/04* (2013.01); *C10M 133/22* (2013.01); *C10M 133/28* (2013.01); *C10M 133/54* (2013.01); *C10M 133/58* (2013.01); *C10M 135/18* (2013.01); *C10M 135/36* (2013.01); *C10M 2203/065* (2013.01); *C10M 2203/104* (2013.01); *C10M 2203/1025* (2013.01); *C10M 2205/003* (2013.01); *C10M 2205/022* (2013.01); *C10M 2205/0285* (2013.01); *C10M 2205/223* (2013.01); *C10M 2207/026* (2013.01); *C10M 2215/064* (2013.01); *C10M 2215/14* (2013.01); *C10M 2215/182* (2013.01); *C10M 2215/22* (2013.01); *C10M 2219/066* (2013.01); *C10M 2219/106* (2013.01); *C10N 2230/02* (2013.01); *C10N 2230/04* (2013.01); *C10N 2230/10* (2013.01); *C10N 2230/40* (2013.01); *C10N 2230/45* (2013.01); *C10N 2240/02* (2013.01); *C10N 2240/04* (2013.01); *C10N 2240/10* (2013.01); *C10N 2240/30* (2013.01)

(58) Field of Classification Search

CPC ..... C10M 105/06
USPC ..... 508/110
See application file for complete search history.

(56) References Cited

U.S. PATENT DOCUMENTS

| | | | | |
|---|---|---|---|---|
| 2,719,126 | A * | 9/1955 | Fields et al. | 508/273 |
| 3,036,003 | A | 5/1962 | Verdol | |
| 3,172,892 | A | 3/1965 | LeSuer et al. | |
| 3,200,107 | A | 8/1965 | LeSuer | |
| 3,215,707 | A | 11/1965 | Rense | |

(Continued)

FOREIGN PATENT DOCUMENTS

| | | |
|---|---|---|
| EP | 0471071 B1 | 8/1995 |
| EP | 1669436 A1 | 6/2006 |

(Continued)

OTHER PUBLICATIONS

K. C. Eapen, C. E. Snyder, Jr., L. Gschwender, S. S. Dua and C. Tamborski, "Poly-n-Alkylbenzene Compounds: A Class of Thermally Stable and Wide Liquid Range Fluids", Symposium on Trends in Lube Oil Basestocks Presented Before the Division of Petroleum Chemistry, Inc., American Chemical Society, Philadelphia Meeting, Aug. 26-31, 1984, pp. 1052-1058.

(Continued)

*Primary Examiner* — Taiwo Oladapo
(74) *Attorney, Agent, or Firm* — Robert A. Migliorini

(57) ABSTRACT

Disclosed are compositions of a major amount of alkylated aromatics compounds, in particular alkylated naphthalene and alkylated benzene, optionally combined with API Group II, Group III, Group IV and/or ethylene copolymers, showing improved thermo-oxidation performance when containing an additive combination including an alkylated or non-alkylated diarylamine and a sulfur-containing metal passivator. Particularly, the lubricating compositions include at least 55 wt % of a base oil selected from the group consisting of alkylated naphthalene, alkylated benzene and combinations thereof, and from 0 wt % to 45 wt % of another base oil component. The ratio of amine component to sulfur component in the additive combination is from 1:1 to 20:1. The compositions contain an amount of base oil other than alkylated naphthalene, alkylated benzene and API Group II, Group III, Group IV and/or ethylene copolymers of less than 10 wt % based on the total weight of the components comprising the lubricating composition.

12 Claims, No Drawings

(56) References Cited

U.S. PATENT DOCUMENTS

| | | | |
|---|---|---|---|
| 3,219,666 | A | 11/1965 | Norman et al. |
| 3,254,025 | A | 5/1966 | LeSuer |
| 3,275,554 | A | 9/1966 | Wagenaar |
| 3,316,177 | A | 4/1967 | Dorer, Jr. |
| 3,329,658 | A | 7/1967 | Fields |
| 3,341,542 | A | 9/1967 | LeSuer |
| 3,413,347 | A | 11/1968 | Worrel |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | van der Voort et al. |
| 3,454,607 | A | 7/1969 | LeSuer |
| 3,519,565 | A | 7/1970 | Coleman |
| 3,541,012 | A | 11/1970 | Steube |
| 3,565,804 | A | 2/1971 | Honnen et al. |
| 3,630,904 | A | 12/1971 | Musser |
| 3,632,511 | A | 1/1972 | Liao |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |
| 3,725,277 | A | 4/1973 | Worrel |
| 3,725,480 | A | 4/1973 | Traise et al. |
| 3,726,882 | A | 4/1973 | Traise et al. |
| 3,787,374 | A | 1/1974 | Adams |
| 4,100,082 | A | 7/1978 | Clason et al. |
| 4,234,435 | A | 11/1980 | Meinhardt et al. |
| 4,454,059 | A | 6/1984 | Pindar et al. |
| 4,604,491 | A | 8/1986 | Dressler et al. |
| 4,658,072 | A | 4/1987 | Johnson |
| 4,714,794 | A | 12/1987 | Yoshida et al. |
| 4,889,647 | A | 12/1989 | Rowan et al. |
| 4,978,464 | A | 12/1990 | Coyle et al. |
| 5,034,563 | A | 7/1991 | Ashjian et al. |
| 5,055,626 | A | 10/1991 | Ho et al. |
| 5,171,195 | A | 12/1992 | Funamoto |
| 5,236,610 | A | 8/1993 | Perez et al. |
| 5,275,749 | A | 1/1994 | Kugel et al. |
| 5,344,578 | A | 9/1994 | Wei et al. |
| 5,371,248 | A | 12/1994 | Rudnick |
| 5,382,739 | A | 1/1995 | Atkins et al. |
| 5,395,538 | A | 3/1995 | Rudnick et al. |
| 5,516,954 | A | 5/1996 | Chang et al. |
| 5,552,071 | A | 9/1996 | Rudnick et al. |
| 5,602,086 | A | 2/1997 | Le et al. |
| 5,705,458 | A | 1/1998 | Roby et al. |
| 6,071,864 | A | 6/2000 | Hsi Ho et al. |
| 6,180,575 | B1 | 1/2001 | Nipe |
| 6,326,336 | B1 | 12/2001 | Gallo et al. |
| 6,436,882 | B1 | 8/2002 | Rizvi |
| 6,491,809 | B1 | 12/2002 | Briot et al. |
| 6,599,865 | B1 | 7/2003 | Esche, Jr. et al. |
| 6,806,241 | B2 | 10/2004 | Karol et al. |
| 7,592,495 | B2 | 9/2009 | Hessell et al. |
| 2003/0158051 | A1 | 8/2003 | Karol et al. |
| 2007/0129268 | A1 | 6/2007 | Bell et al. |
| 2008/0300157 | A1* | 12/2008 | Wu et al. ..... 508/591 |
| 2010/0197537 | A1 | 8/2010 | Chase et al. |
| 2011/0082061 | A1 | 4/2011 | Carey et al. |

FOREIGN PATENT DOCUMENTS

| | | | |
|---|---|---|---|
| EP | 2159275 | A2 | 3/2010 |
| GB | 2363128 | A | 12/2001 |
| WO | 9931113 | A1 | 6/1999 |

OTHER PUBLICATIONS

Dressler, H., R.L. Shubkin (Ed.) "Synthetic Lubricants and High Performance Functional Fluids", Marcel Dekker, N.Y. 1993, chap. 5.

* cited by examiner

ANTIOXIDANT COMBINATION AND SYNTHETIC BASE OILS CONTAINING THE SAME

CROSS-REFERENCE TO RELATED APPLICATIONS

This application claims the benefit of U.S. Provisional Application Ser. No. 61/614,223, filed on Mar. 22, 2012; which is incorporated herein in its entirety by reference

FIELD

This disclosure is directed to novel antioxidant compositions and lubricating oils containing the same. The novel antioxidant combination is comprised of alkylated or non-alkylated diaryl amines, or mixtures of alkylated and non-alkylated diamines, and a sulfur containing metal passivator. The synthetic lubricating base oils are comprised of a major amount of Group V synthetic alkylated aromatic base oil such as alkylated benzene (AB) or alkylated naphthalene (AN) with, optionally, a minor amount of API Group II, Group III or Group IV synthetic base oil, preferably polyalphaolefin (PAO).

BACKGROUND

Industrial machinery often requires lubricating compositions, for example gears, bearings, couplings, and pumps. Additives in the lubricating compositions are often used to help to improve the operational qualities of the lubricants depending upon the conditions of operation.

U.S. Pat. No. 5,236,610 relates to an antioxidant additive for an engine or propulsion system lubricant subjected to high temperatures which includes a high molecular weight substituted phenolic carboxylic acid tetraester of pentaerythritol. A lubricant blend which is capable of solubilizing the antioxidant additive includes a polyolester, a phosphate ester and at least one of a polyalphaolefin and alkylated naphthalene. Specifically claimed compositions are a liquid lubricant comprising a mixture of 25-65 weight percent of a polyolester, 5-15 weight percent of a phosphate ester, 25-65 weight percent of at least one synthetic hydrocarbon selected from the group consisting of a polyalphaolefin and an alkylated naphthalene, and an effective antioxidant amount of at least one compound selected from the group consisting of phenyl naphthylamine, diphenylamine, a methylene bis(dialkyl-dithiocarbamate), a methylene bis(diaryl-dithiocarbamate), a 2,6-dialkyl-p-cresol, a bisphenol of a 2,6-dialkyl-p-cresol, and a tri-substituted phosphite. All of the lubricants require both polyolester and phosphate ester.

U.S. Pat. No. 5,275,749 relates to the lubricating compositions containing an N-acyl-N-alkoxyalkyl aspartate ester, optionally in further combination with an anti-wear agent. The compositions are said to exhibit corrosion inhibition and anti-wear properties. Dialkyl carbamate and arylamine are mentioned as additives. The base oils can include synthetic hydrocarbon base oils, but alkylated naphthalene is not mentioned.

U.S. Pat. No. 6,326,336 relates to a turbine lubricant consisting of (A) alkylated diphenylamine and/or phenylnaphthylamines, and (B) sulfurized olefins and/or sulfurized fatty acids and/or ashless dithiocarbamates and/or tetraalkylthiuram disulfides, with the balance containing (C) base oils characterized by very low sulfur contents (<0.03 wt %) and a high level of saturates (>90 volume %), and optionally (D) neutral rust inhibitors. A particularly claimed composition is a turbine lubricating oil comprising (A) an amine antioxidant comprising a mixture of alkylated diphenylamines and phenyl-naphthylamines; (B) a sulfur-containing additive selected from the group consisting of sulfurized olefins, ashless dithiocarbamates, tetraalkylthiuram disulfides and mixtures thereof; and (C) a base mineral oil having a sulfur content of less than 0.03 wt % and greater than 90 volume % saturates. The base oil stocks are said to not include Group V base stocks.

GB2363128 relates to industrial oil compositions which require trimeric organo molybdenum compounds as antioxidants and uses a combination of dithiocarbamate and arylamine in comparative examples. The base stock is selected form Group I, II, III and IV.

U.S. Pat. No. 6,599,865 relates to a lubricating composition comprising a major amount of lubricating oil, and a minor amount of an oil soluble alkylated diarylamine, an oil soluble alkylated phenothiazine, and an oil soluble sulfurized compound, said sulfurized compound selected from the group consisting of sulfurized olefins and sulfurized fatty oils. This patent discloses that it has unexpectedly been found that the combination of (1) an alkylated diphenylamine, (2) a sulfurized olefin/fatty oil and/or an ashless dialkyl dithiocarbamate, and (3) an alkylated phenothiazine, is highly effective at controlling crankcase lubricant oxidation and deposit formation. There is no mention of using alkylated naphthalene as the base oil, and the patent requires the three component additive system.

U.S. Pat. No. 6,806,241 relates to antioxidant compositions comprising (1) an organo molybdenum compound, (2) an alkylated diphenylamine, and (3) a sulfur compound selected from (a) thiadiazole, (b) a dithiocarbamate and (c) a metal dithiocarbamate. There is no mention of alkylated naphthalene as the base oil.

Pub. U.S. 20070129268 relates to a lubricating oil composition containing one or more hydrocarbyl-substituted aromatic lubricant base oils in combination with (a) one or more phenyl-naphthylamines, and (b) one or more diphenyl amines, where said lubricating oil composition comprises one or more additional lubricant base oils comprising polyalphaolefin and/or Fischer-Tropsch derived base oils. It is said that the disclosure relates to the use of the lubricating oil composition for lubricating a rotary air compressor. The only mention of dithiocarbamates is as the molybdenum complex, said to be suitable as an anti-wear additive.

EP2159275 relates to a lubricating composition comprising base oil selected from the group consisting of Fischer-Tropsch derived base oil and a poly-alpha olefin (PAO) base oil or a combination thereof; a detergent; and an amine compound. Dithiocarbamates and aryl amines are exemplified and alkylated naphthalene is mentioned as a possible component of the base oil.

Pub. U.S. 20100197537 relates to a lubricant composition said to have improved antioxidant capability which includes an additive composition containing a metal free sulfur-containing compound, an aromatic amine, and a hindered amine Particularly effective metal-free sulfur-containing compounds are said to include ashless dithiocarbamates, such as ethylenebis (dibutyldithiocarbamate), and sulfurized fatty acids.

The operating temperature and efficiency of any lubricating composition is especially important to the designers, builders, and user of certain industrial machinery. Next generation synthetic industrial lubricants will have higher performance demands such as step-out thermo-oxidation performance. Formulations able to demonstrate a higher level of performance will have longer oil life and increased drain intervals. Other attributes for these fluids include higher temperature capability and reduced environmental footprint.

Oxidative stability is key in achieving long oil life. Controlling oil viscosity increase through identifying robust performing base stock and additive combinations can minimize deposit (varnish/sludge) formation, and maintain good heat transfer and lubricating properties, including efficiency. The reduced oxidation, and thus increased performance of a lubricant, is especially desirable in high temperature applications and environments. Oxidation testing is an important part of assessing the potential stability of a lubricant for use in most lubricating applications including air compressors and gear oils. The high volumes of air and high temperatures experienced by a lubricant in an air compressor can have a large effect on the lubricant's oxidative stability. Assessing the stability of a lubricant in oxidation tests are methods by which a formulator can determine the potential stability of an air compressor lubricant in service. Oxidation tests have been developed to determine the length of time it takes for a lubricant to degrade from oxidation or break to a catastrophic increase in viscosity. These methods are used to evaluate mineral and synthetic lubricants, with or without additives. The evaluation is based on the resistance of the lubricant to oxidation by air under specified conditions as measured by the changes in viscosity.

Total acid number (TAN) increase in a lubricant is a sensitive way to detect oxidation of the base oils and additives. TAN measures the by-products of oxidation. Upward trending TAN can determine the rate of depletion of additives, as well as indicate when oxidation rate significantly increases, rendering the fluid potentially harmful to the equipment. Common problems for the equipment caused by an oxidized lubricant are corrosion and deposit formation. Increasing the time to reach TAN limits is a valuable gauge of the quality of the performance of a lubricant. Oil life is determined when the TAN reaches a prescribed limit. The limit is nominally set in two ways: approximately 2.0 mg KOH/g above the baseline TAN; or the time in which the lubricant shows a significant slope change (vertical) from the previously determined value.

Kinematic Viscosity (KV) increase is another measure that is commonly used to determine oil failure due to oxidation. Tests conducted in high temperature (170° C.) environments with a catalyst, are a means to measure whether any particular oil has a longer oil life when compared to references.

For measuring KV increase, the sample is placed in an oxidation cell together with various organometallic catalysts that are dissolved in solution and then placed into the test cell. The cell and its contents are placed in a heating block maintained at a specified temperature, and a measured volume of dried air is bubbled through the test cell held at a pressure ranging from 0-100 psig for the duration of the test, with an air flow rate up to 250 cc/min. A constant temperature block, equipped with an electric heater and thermostatic control capable of maintaining the temperature within +/−1° F. (0.5° C.) in the range of 200° F. (93° C.) to 450° F. (232° C.) is used to maintain the specified temperature.

Periodically the test cell is sampled for viscosity until the oil has oxidized. The oil condition is examined by measuring its KV at a specified temperature. Comparisons can then be made to the original KV of the oil. The time at which it takes the oil to reach a catastrophic increase in viscosity (200%) is used to determine the endpoint of the test.

Thus, it is an object of the present disclosure to provide a lubricant composition which has reduced oxidation over conventional lubricants.

It is also an object of the present disclosure to provide a lubricant composition which has longer time-to-TAN or viscosity increase characteristics as compared to the lubricants presently in use.

It is a further object of the present disclosure to provide a lubricant composition having better high temperature performance as compared to lubricants presently in use.

It is a still further object of the present disclosure to provide an additive composition for use in lubricants which provides improvement to the above-mentioned characteristics of lubricant compositions, including extending oxidation performance, and reducing corrosion and deposit formation.

These and other objects are accomplished by the present disclosure which will now be described below.

SUMMARY

According to one aspect of the disclosure, there is provided a lubricating composition comprising a blend or admixture of components.

In one of its aspects the lubricating composition comprises, in admixture, at least 55 wt % of a base oil component comprising alkylated aromatic, such as those selected from the group consisting of alkylated naphthalene, alkylated benzene and combinations of any of the foregoing, and from 0 wt % to 45 wt % of a base oil component comprised of API Group II, Group III, Group IV, ethylene copolymers and combinations of any of the foregoing, based on the total weight of the admixed components that are used to produce the lubricating composition, and an additive combination comprised of alkylated diarylamine, non-alkylated diarylamine and combinations thereof and a sulfur-containing metal passivator, wherein the amount of base oil other than alkylated aromatic, such as alkylated naphthalene, alkylated benzene and, if present, API Group II, Group III, Group IV and/or ethylene copolymer, is less than 10 wt % based on the total weight of the admixed components that comprise the lubricating composition. In other words, the lubricating composition of the present disclosure should have not more than 10 wt %, based on the total weight of the admixed components that comprise the lubricating composition, of any base oil other than alkylated aromatic such as alkylated naphthalene, alkylated benzene, API Group II, Group III, Group IV and/or ethylene copolymer. When present, the preferred co-base stock is PAO.

According to another aspect of the disclosure, there is provided a method for producing a lubricating composition, which comprises blending the components together.

In one of its broader aspects, the method comprises blending at least 55 wt % of a base oil component comprising alkylated aromatic, such as those selected from the group consisting of alkylated naphthalene, alkylated benzene and mixtures thereof, and from 0 wt % to 45 wt % of a base oil component comprised of API Group II, Group III, Group IV, ethylene copolymers and combinations of any of the foregoing, based on the total weight of the admixed components that are used to produce the lubricating composition, and adding thereto an additive combination comprised of alkylated diarylamine, non-alkylated diarylamine and combinations thereof and a sulfur-containing metal passivator, wherein the amount of base oil other than alkylated aromatic, such as alkylated naphthalene, alkylated benzene and, if present, API Group II, Group III, Group IV and/or ethylene copolymer is less than 10 wt % based on the total weight of the admixed components that comprise the lubricating composition.

The base oils(s) may be combined first, and the components of the additive may be added sequentially or concurrently to the base oil(s), or one or more of the additive components may be add to either of the base oils, or part of each of the additives may be added to each of the base oil(s).

According to yet another aspect of the disclosure there is provided an additive composition which imparts improved properties to the lubricating composition.

In one of its broader aspects, the additive composition for a base oil lubricating composition is comprised of alkylated or non-alkylated diaryl amines or mixed alkylated and non-alkylated diaryl amines (amine component) and alkyl dithio carbamate, dialkyl dimercaptothiadiazole and/or other sulfur containing metal passivator (sulfur component), wherein the ratio of amine component to sulfur component is from 1:1 to 20:1.

And in yet another aspect of the disclosure there is provided a method of improving the properties of a lubricating composition which comprises adding the additive composition of the present disclosure to a lubricating composition.

In one of its broader aspects, the method for improving the oxidation resistance of a base oil lubricant composition comprises adding an additive comprised of alkylated or non-alkylated diaryl amines or mixed alkylated and non-alkylated diaryl amines (amine component) and alkyl dithio carbamate, dialkyl dimercaptothiadiazole and/or other sulfur containing metal passivator (sulfur component), wherein the ratio of amine component to sulfur is from 1:1 to 20:1, to a base oil. Preferably, the additive is added to a base oil comprising at least 55 wt % of a base oil component comprising alkylated aromatic, such as those selected from the group consisting of alkylated naphthalene, alkylated benzene and combinations of any of the foregoing, and from 0 wt % to 45 wt % of a base oil component comprised of API Group II, Group III, Group IV, ethylene copolymers and combinations of any of the foregoing, based on the total weight of the admixed components that are used to produce the lubricating composition.

DETAILED DESCRIPTION

All numerical values within the detailed description and the claims herein are modified by "about" or "approximately" the indicated value, and take into account experimental error and variations that would be expected by a person having ordinary skill in the art.

Base Stock(s):

The terms "base oil" and "base stock" as referred to herein are to be considered consistent with the definitions as stated in API APPENDIX E—API BASE OIL INTERCHANGEABILITY GUIDELINES FOR PASSENGER CAR MOTOR OILS AND DIESEL ENGINE OILS, July 2009 Version. According to Appendix E, base oil is the base stock or blend of base stocks used in API-licensed oil. Base stock is a lubricant component that is produced by a single manufacturer to the same specifications (independent of feed source or manufacturer's location), that meets the same manufacturer's specification, and that is identified by a unique formula, product identification number, or both. The lubricating composition of the present disclosure comprises an API Group V base oil component. The Group V base oil component is a Group V base stock or a blend of more than one Group V base stock. Group V base stocks include all other base stocks not included in Group I, II, III, or IV, as set forth in APPENDIX E. Group I base stocks contain less than 90 percent saturates, tested according to ASTM D2007 and/or greater than 0.03 percent sulfur, tested according to ASTM D1552, D2622, D3120, D4294, or D4927; and a viscosity index of greater than or equal to 80 and less than 120, tested according to ASTM D2270. Group II base stocks contain greater than or equal to 90 percent saturates; less than or equal to 0.03 percent sulfur; and a viscosity index greater than or equal to 80 and less than 210. Group III base stocks contain greater than or equal to 90 percent saturates; less than or equal to 0.03 percent sulfur; and a viscosity index greater than or equal to 120. Group IV base stocks are polyalphaolefin (PAOs). The base oil or base stock of the present disclosure can be the Group V base stock alone, or in combination with a co-base stock.

The components of the lubricating composition of the present disclosure include a dominant portion of Group V base stock, i.e., an alkylated aromatic component. As used herein, the phrase dominant portion means at least 55 wt % of the total amount of base oil in the lubricating composition. Preferably the alkylated aromatics component is alkylated benzene (AB) or alkylated naphthalene (AN) component. Preferably, the alkylated aromatics component is present in amount of from 55 wt % to 90+ wt % of the lubricant composition, more preferably of from 60 wt % to 85 wt % of the lubricant composition, and most preferably of from 60 wt % to 75 wt % of the lubricant composition. In other embodiments, the alkyl aromatics component of the lubricating compositions is the only base oil in the lubricating compositions.

Alkylated aromatic base stock components useful in this disclosure include, for example, alkylated naphthalenes and alkylated benzenes. The alkylated aromatic base stock may be any hydrocarbyl molecule that contains at least 5% of its weight derived from an aromatic moiety such as a benzenoid moiety or naphthenoid moiety, or their derivatives. These alkylated aromatic base stocks include alkyl benzenes, alkyl naphthalenes, alkyl diphenyl oxides, alkyl naphthols, alkyl diphenyl sulfides, alkylated bis-phenol A, alkylated thiodiphenol, and the like. The alkylated aromatic base stock may be mono-alkylated, dialkylated, polyalkylated, and the like. The aromatic can be mono- or poly-functionalized. The hydrocarbyl groups may range from $C_6$ up to $C_{60}$ with a range of $C_8$ to $C_{40}$ often being preferred. A mixture of hydrocarbyl groups is often preferred. The hydrocarbyl group may optionally contain sulfur, oxygen, and/or nitrogen containing substituents. The aromatic group may also be derived from natural (petroleum) sources, provided at least 5% of the molecule is comprised of an above-type aromatic moiety. Viscosities at 100° C. of approximately 3 cSt to 50 cSt are preferred, with viscosities of approximately 3.4 cSt to 20 cSt often being more preferred for the alkylated aromatic base stock. Naphthalene or methyl naphthalene, for example, may be alkylated with olefins such as octene, decene, dodecene, tetradecene or higher, mixtures of similar olefins, and the like.

Illustrative alkylated naphthalenes useful in the present disclosure are described, for example, in U.S. Patent Publication No. 2008/0300157, herein incorporated by reference in its entirety.

Non-limiting examples of typical alkyl naphthalenes are mono-, di-, tri-, tetra-, or penta-$C_3$ alkyl naphthalene, $C_4$ alkyl naphthalene, $C_5$ alkylnaphthalene, $C_6$ alkyl naphthalene, $C_8$ alkyl naphthalene, $C_{10}$ alkyl naphthalene, $C_{1-2}$ alkyl naphthalene, $C_{1-4}$ alkyl naphthalene, $C_{1-6}$ alkyl naphthalene, $C_{1-8}$ alkyl naphthalene, $C_{10}$-$C_{14}$ mixed alkyl naphthalene, $C_6$-$C_{18}$ mixed alkyl naphthalene, or the mono-, di-, tri-, tetra-, or penta-$C_3$, $C_4$, $C_5$, $C_6$, $C_8$, $C_{10}$, $C_{12}$, $C_{14}$, $C_{16}$, $C_{18}$ or mixture thereof alkyl monomethyl, dimethyl, ethyl, diethyl, or methylethyl naphthalene, or mixtures thereof. The alkyl group can also be branched alkyl group with $C_{10}$-$C_{300}$, e.g., $C_{24}$-$C_{56}$ branched alkyl naphthalene, $C_{24}$-$C_{56}$ branched alkyl mono-, di-, tri-, tetra- or penta-$C_1$-$C_4$ naphthalene, and combinations thereof. These branched alkyl group substituted naphthalenes or branched alkyl group substituted mono-, di-, tri-, tetra- or penta-$C_1$-$C_4$ naphthalene may also be used as mixtures with the previously recited materials. These branched alkyl group may be prepared from oligomerization of small olefins, such as $C_5$-$C_{24}$ alpha- or internal-olefins. When the branched alkyl group is very large (that is 8 to 300 carbons), usually only one or two of such alkyl groups are attached to the naphthalene core. The alkyl groups on the naphthalene ring may also be mixtures of the above alkyl groups. Sometimes mixed alkyl groups are advantageous because they may provide more improvement of pour points and low temperature fluid properties. The fully hydrogenated fluid alkylnaphthalenes may also be used for blending with GTL base stock/base oil, but the alkyl naphthalenes are preferred.

Typically the alkyl naphthalenes are prepared by alkylation of naphthalene or short chain alkyl naphthalene, such as methyl or di-methyl naphthalene, with olefins, alcohols or alkylchlorides of 6 to 24 carbons over acidic catalyst inducing typical Friedel-Crafts catalysts. Typical Friedel-Crafts catalysts are $AlCl_3$, $BF_3$, HT, zeolites, amorphous aluminiosilicates, acid clays, acidic metal oxides or metal salts, USY, etc.

Methods for the production of alkylnaphthalenes suitable for use in the present disclosure are described in U.S. Pat. Nos. 5,034,563, 5,516,954, and 6,436,882, herein incorporated by reference in their entirety, as well as in references cited in these patents, as well as taught elsewhere in the literature.

The naphthalene or mono- or di-substituted short chain alkyl naphthalenes may be derived from any conventional naphthalene-producing process from petroleum, petrochemical process or coal process or source stream. Naphthalene-containing feeds can be made from aromaticization of suitable streams available from the F-T process. For example, aromatization of olefins or paraffins can produce naphthalene or naphthalene-containing component. Many medium or light cycle oils from petroleum refining processes contain significant amounts of naphthalene, substituted naphthalenes or naphthalene derivatives. Indeed, substituted naphthalenes recovered from whatever source, if possessing up to three alkyl carbons can be used as raw material to produce alkylnaphthalene for this disclosure. Furthermore, alkylated naphthalenes recovered from whatever source or processing can be used in the present method, provided they possess kinematic viscosities, VI, pour point, etc.

Suitable alkylated naphthalenes are available commercially from ExxonMobil under the tradename Synesstic AN or from King Industries under the tradename NA-Lube naphthalene-containing fluids.

Non-limiting illustrative alkylated benzenes useful in this disclosure include, for example, those described in U.S. Patent Publication 2008/0300157, herein incorporated by reference Alkylated benzenes having a viscosity at 100° C. of 1.5 to 600 cS, a VI of 0 to 200 and a pour point of 0° C. or less, preferably −15° C. or less, more preferably −25° C. or less, still more preferably −35° C. or less, most preferably −60° C. or less are useful for this disclosure.

Non-limiting illustrative monoalkylated benzenes include, for example, linear $C_{10}$-$C_{30}$ alkyl benzene or a $C_{10}$-$C_{300}$ branched alkyl benzene, preferably $C_{10}$-$C_{100}$ branched alkyl benzene, more preferably $C_{15}$-$C_{50}$ branched alkyl group. Illustrative multialkylated benzenes include, for example, those in which one or two of the alkyl groups can be small alkyl radical of $C_1$-$C_5$ alkyl group, preferably $C_1$-$C_2$ alkyl group. The other alkyl group or groups can be any combination of linear $C_{10}$-$C_{30}$ alkyl group, or branched $C_{10}$ and higher up to $C_{300}$ alkyl group, preferably $C_{15}$-$C_{50}$ branched alkyl group. These branched large alkyl radicals can be prepared from the oligomerization or polymerization of $C_3$ to $C_{20}$, internal or alpha-olefins or mixture of these olefins. The total number of carbons in the alkyl substituents may range from $C_{10}$-$C_{300}$. Preferred alkyl benzene fluids can be prepared according to U.S. Pat. Nos. 6,071,864 and 6,491,809, herein incorporated by reference.

Included in this class of base stock blend components are, for example, long chain alkylbenzenes and long chain alkyl naphthalenes which are preferred materials since they are hydrolytically stable and may therefore be used in combination with the PAO component of the base stock in wet applications. The alkylnaphthalenes are known materials and are described, for example, in U.S. Pat. No. 4,714,794, herein incorporated by reference. The use of a mixture of monoalkylated and polyalkylated naphthalene as a base for synthetic functional fluids is also described in U.S. Pat. No. 4,604,491, herein incorporated by reference. The preferred alkylnaphthalenes are those having a relatively long chain alkyl group typically from 10 to 40 carbon atoms although longer chains may be used if desired. Alkylnaphthalenes produced by alkylating naphthalene with an olefin of 14 to 20 carbon atoms has particularly good properties, especially when zeolites such as the large pore size zeolites are used as the alkylating catalyst, as described in U.S. Pat. No. 5,602,086, herein incorporated by reference. These alkylnaphthalenes are predominantly monosubstituted naphthalenes with attachment of the alkyl group taking place predominantly at the 1- or 2-position of the alkyl chain. The presence of the long chain alkyl groups confers good viscometric properties on the alkyl naphthalenes, especially when used in combination with the PAO components which are themselves materials of high viscosity index, low pour point and good fluidity.

An alternative secondary blend stock is an alkylbenzene or mixture of alkylbenzenes. The alkyl substituents in these fluids are typically alkyl groups of 8 to 25 carbon atoms, usually from 10 to 18 carbon atoms and up to three such substituents may be present, as described in ACS Petroleum Chemistry Preprint 1053-1058, "Poly n-Alkylbenzene Compounds: A Class of Thermally Stable and Wide Liquid Range Fluids", Eapen et al, Phila. 1984, herein incorporated by reference. Tri-alkyl benzenes may also be produced by the cydodimerization of 1-alkynes of 8 to 12 carbon atoms as described in U.S. Pat. No. 5,055,626, herein incorporated by reference. Other alkylbenzenes are described in U.S. Pat. No. 4,658,072, herein incorporated by reference. Alkylbenzenes have been used as lubricant base stocks, especially for low temperature applications. They are commercially available from producers of linear alkylbenzenes (LABs) such as Vista Chemical Co, Huntsman Chemical Co. as well as Chevron-Texaco and Nippon Oil Co. The linear alkylbenzenes typically have good low pour points and low temperature viscosities and VI values greater than 100 together with good solvency for additives. Other alkylated aromatics which may be used when desirable are described, for example, in "Synthetic Lubricants and High Performance Functional Fluids", Dressler, H., chap 5, (R. L. Shubkin (Ed.)), Marcel Dekker, N.Y. 1993, herein incorporated by reference.

Also included in this class and with very desirable lubricating characteristics are the alkylated aromatic compounds including the alkylated diphenyl compounds such as the alkylated diphenyl oxides, alkylated diphenyl sulfides and alkylated diphenyl methanes and the alkylated phenoxathins as well as the alkylthiophenes, alkyl benzofurans and the ethers of sulfur-containing aromatics. Lubricant blend components of this type are described, for example, in U.S. Pat. Nos. 5,552,071; 5,171,195; 5,395,538; 5,344,578; and 5,371,248, all of which are herein incorporated by reference.

The Group IV base stock is comprised of a metallocene PAO or regular PAO, or combinations thereof. In one embodiment, the metallocene PAO (or mPAO) used for this disclosure can be a copolymer made from at least two alpha-olefins, or a homopolymer made from a single alpha-olefin feed by a metallocene catalyst system. The copolymer mPAO composition is made from at least two alpha-olefins preferably of $C_3$-$C_{30}$ range and having monomers randomly distributed in the polymers. It is preferred that the average carbon number is at least 4.1. Advantageously, ethylene and propylene, if present in the feed, are present in the amount of less than 50 wt % individually or preferably less than 50 wt % combined. The copolymers of the mPAO can be isotactic, atactic, syndiotactic polymers or any other form of appropriate tacticity. These copolymers have useful lubricant properties including excellent viscosity indices (VI), pour point, and low temperature viscometrics. Furthermore, these copolymers have narrow molecular weight distributions and excellent lubricating properties.

In an embodiment, mPAO is made from the mixed feed LAOs (linear alpha olefins) comprising at least two and up to 26 different linear alpha-olefins selected from $C_3$-$C_{30}$ linear alpha-olefins. In a preferred embodiment, the mixed feed LAO is obtained from an ethylene growth process using an aluminum catalyst or a metallocene catalyst. The growth olefins comprise mostly $C_6$-$C_{18}$-LAO. LAOs from other processes, such as the SHOP process, can also be used.

Homopolymer mPAO compositions are made from single alpha-olefin chosen from the $C_3$-$C_{30}$ range, preferably $C_3$-$C_{16}$, most preferably $C_3$-$C_{14}$ or $C_3$-$C_{12}$. The homopolymers can be isotactic, atactic, syndiotactic polymers or any combination of these tacticity or other form of appropriate tacticity. Often the tacticity can be carefully tailored by the polymerization catalyst and polymerization reaction condition chosen or by the hydrogenation conditions chosen. These homopolymers have useful lubricant properties including excellent VI, pour point, and low temperature viscometrics. Furthermore, these homopolymers have narrow molecular weight distributions and excellent lubricating properties.

The alpha-olefin(s) can be used alone to make homopolymer or together with another LAO to make a copolymer, including propylene, 1-butene, 1-pentene, and the like, or with 1-hexene or 1-octene. In another embodiment, the alpha-olefins can be chosen from the alpha-olefins produced from Fischer-Tropsch synthesis (as reported in U.S. Pat. No. 5,382,739). For example, $C_3$-$C_{16}$ alpha-olefins, more preferably linear alpha-olefins, are suitable to make homopolymers. Other combinations, such as $C_4$ and $C_{14}$-LAO; $C_6$ and $C_{16}$-LAO; $C_8$, $C_{10}$, $C_{12}$-LAO; or $C_8$ and $C_{14}$-LAO; $C_6$, $C_{10}$, $C_{14}$-LAO, $C_4$ and $C_{12}$-LAO, etc. are suitable to make copolymers.

When the alkyl aromatics component of the lubricating compositions is admixed with another base oil component, that other base oil component is preferably Group IV PAO base oil, as described above. As used herein, PAO includes polyalphaolefin, as well as ethylene copolymers, ethylene-propylene copolymers and metallocene PAO. Thus, the PAO in the lubricating compositions of the present disclosure should be present in an amount of not more than 45 wt % of the total amount of base oil in the composition. Preferably, the PAO, when present, is present in an amount of between 5 wt % to 40 wt %, and more preferably in an amount of between 10 wt % to 30 wt %. In any event, the amount of base oil other than alkylated aromatics and/or API Group II, Group III and/or Group IV in the base oil composition of the present disclosure should be less than 10 wt % based on the total amount of base oil in the lubricating composition, preferably less than 5 wt %, more preferably less than 2 wt % and most preferably less than 1-2 wt %. The base oil component of the present disclosure can be substantially free, or free, of base oils other than alkyl aromatics and, optionally, API Group II, Group III and/or Group IV base oils. In other words, the base oil composition of the present disclosure can consistent essentially of AN and/or AB in admixture alone, or with, optionally, API Group II, Group III and/or Group IV base oils. Preferably, the lubricating composition of this disclosure is primarily comprised of Group V base oil component or a blend or admixture of Group V base oil component and Group IV base oil component.

The kinematic viscosity at 100° C. (KV 100) of the alkylated aromatics component of the lubricating composition should be in the range of from 3 cSt to 25 cSt, and preferably from 5 cSt to 15 cSt. The kinematic viscosity at 100° C. (KV 100) of the PAO component of the lubricating composition should be in the range of from 2 cSt to 2000 cSt, preferably from 4 cSt to 300 cSt, and more preferably from 4 cSt to 150 cSt. The KV 40 of the final composition of the present disclosure is desirably within the range of from 15 cSt to 1500 cSt and more preferably in the range of from 30 cSt to 1000 cSt. Those skilled in the art are aware of methods of blending the base oil components of the present disclosure in a manner to arrive at the desired KV of the final composition described herein. The additive composition of the present disclosure is comprised of an additive composition comprised of alkylated or non-alkylated diaryl amine or mixed alkylated or non-alkylated diaryl amines; for example, alkylated diphenylamine or alkylated phenyl naphthylamine or mixtures thereof (amine component), and alkyl dithio carbamate, or dialkyl dimercaptothiadiazole and/or other and sulfur-containing metal passivator (sulfur component). Preferably, the alkyl dithio carbamate is a dialkyl dithio carbamate, and more preferably the dialkyl dithio carbamate is ashless and/or substantially metal free, or metal free, and in particular free of molybdenum. The amount of each of the amine component and sulfur component in the lubricating composition of the present disclosure may be present in amounts of up to 2 wt %, based on 100 wt % of the total lubricating composition, but greater amounts can be used in any particular composition. Preferably, the amount of each of the amine component and sulfur component in the lubricating composition of the present disclosure should be from 0.05 wt % to 2 wt %, and more preferably from 0.5 wt % to 2 wt %, based on 100 wt % of the total lubricating composition. More preferred ranges of the amine component are between 0.3 wt % to 2.0 wt %, and for the sulfur component are between 0.05 wt % to 0.5 wt %, based on 100 wt % of the total lubricating composition. The ratio of amine component to sulfur component is not critical. Preferably, the ratio of amine component to sulfur component is 1:1 or greater, such as from 2:1 to 20:1, preferably 2:1 to 10:1, but greater or lesser ratios may be used in any particular lubricating composition, depending upon the preferences of the fabricator of the lubricant composition.

Other Additives:

The formulated lubricating oil useful in the present disclosure may additionally contain one or more of the other commonly used lubricating oil performance additives including, but not limited to, dispersants, other detergents, corrosion inhibitors, rust inhibitors, metal deactivators, other anti-wear agents and/or extreme pressure additives, anti-seizure agents, wax modifiers, viscosity index improvers, viscosity modifiers, fluid-loss additives, seal compatibility agents, other friction modifiers, lubricity agents, anti-staining agents, chromophoric agents, demulsifiers, emulsifiers, densifiers, wetting agents, gelling agents, tackiness agents, colorants, antioxidants or oxidation inhibitors, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973) and "Lubricant Additives: Chemistry and Applications" edited by L. R. Rudnick, published by CRC Press of Boca Raton, Fla. (2009).

The types and quantities of performance additives used in combination with the instant disclosure in lubricant compositions are not limited by the examples shown herein as illustrations. The presence or absence of these lubricating oil performance additives does not adversely affect the compositions of this disclosure.

When present, the other additives may be present in a total amount of less than 5 wt % of the total weight of the lubricating composition, preferably less than 4 wt % and more preferably less than 3 wt %. Total amounts of other additives of less than 1 wt % may be used in some embodiments. The amount of each of the amine component and sulfur component can be more than any of the individual amounts of additional additives, and the total wt % of the combination of amine component and sulfur component can be equal to or greater than the total wt % of the combination of the other additives. The alkylated diaryl amine is generally recognized as an antioxidant. In preferred embodiments, the alkylated diaryl amine is present in an amount greater than that of other commonly recognized antioxidants, such as phenol ester and phenolic antioxidants, and in other preferred embodiments the composition is substantially free, or free, of other generally recognized antioxidants. Likewise, the alkyl dithio carbamate is generally recognized as an antiwear agent. The alkyl dithio carbamate may be present in an amount greater than that of other commonly recognized antiwear agents, such as metal-containing alkyl dithio carbamate and/or phosphate-containing antiwear agents, and the composition may be substantially free, or free, of other generally recognized antiwear agents.

Viscosity Improvers

Viscosity improvers (also known as Viscosity Index modifiers, and VI improvers) increase the viscosity of the oil composition at elevated temperatures which increases film thickness, while having limited effect on viscosity at low temperatures.

Suitable viscosity improvers include high molecular weight hydrocarbons, polyesters and viscosity index improver dispersants that function as both a viscosity index improver and a dispersant. Typical molecular weights of these polymers are between 10,000 to 1,000,000, more typically 20,000 to 500,000, and even more typically between 50,000 and 200,000.

Non-limiting examples of suitable viscosity improvers are polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

The amount of viscosity modifier may range from zero to 8 wt %, preferably zero to 4 wt %, more preferably zero to 2 wt % based on active ingredient and depending on the specific viscosity modifier used.

Antioxidants

Typical antioxidants include phenolic antioxidants, aminic antioxidants and oil-soluble copper complexes.

The phenolic antioxidants include sulfurized and non-sulfurized phenolic antioxidants. The terms "phenolic type" or "phenolic antioxidant" used herein include compounds having one or more than one hydroxyl group bound to an aromatic ring, which may itself be mononuclear, e.g., benzyl, or poly-nuclear, e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bisphenol type compounds including such bi-phenol compounds linked by alkylene bridges sulfuric bridges or oxygen bridges. Alkyl phenols include mono- and poly-alkyl or alkenyl phenols, the alkyl or alkenyl group containing from 3-100 carbons, preferably 4 to 50 carbons and sulfurized derivatives thereof, the number of alkyl or alkenyl groups present in the aromatic ring ranging from 1 to up to the available unsatisfied valences of the aromatic ring remaining after counting the number of hydroxyl groups bound to the aromatic ring.

Generally, therefore, the phenolic antioxidant may be represented by the general formula:

$$(R)_x—Ar—(OH)_y$$

where Ar is selected from the group consisting of:

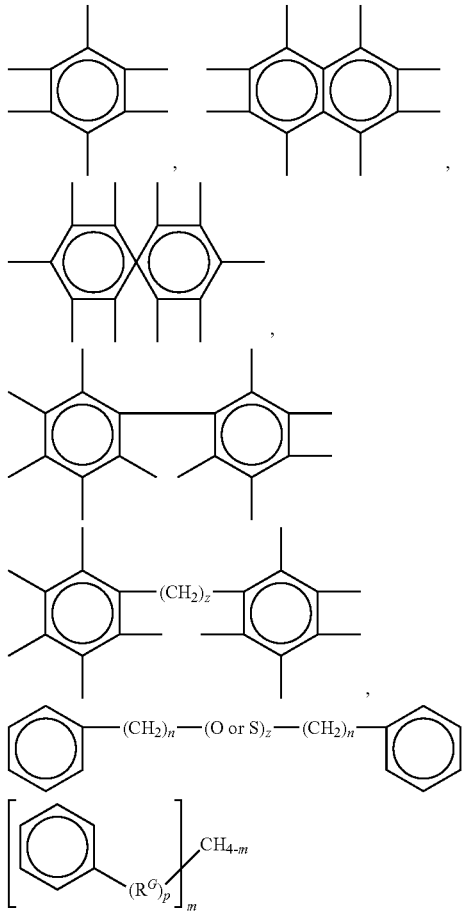

wherein R is a $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably a $C_4$-$C_{50}$ alkyl group, $R^g$ is a $C_1$-$C_{100}$ alkylene or sulfur substituted alkylene group, preferably a $C_2$-$C_{50}$ alkylene or sulfur substituted alkylene group, more preferably a $C_2$-$C_2$ alkylene or sulfur substituted alkylene group, y is at least 1 to up to the available valences of Ar, x ranges from 0 to up to the available valances of Ar-y, z ranges from 1 to 10, n ranges from 0 to 20, and m is 0 to 4 and p is 0 or 1, preferably y ranges from 1 to 3, x ranges from 0 to 3, z ranges from 1 to 4 and n ranges from 0 to 5, and p is 0.

Preferred phenolic antioxidant compounds are the hindered phenolics and phenolic esters, which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_1$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; 2-methyl-6-t-butyl-4-dodecyl phenol; 2,6-di-t-butyl-4 methyl phenol; 2,6-di-t-butyl-4-ethyl phenol; and 2,6-di-t-butyl 4 alkoxy phenol; and

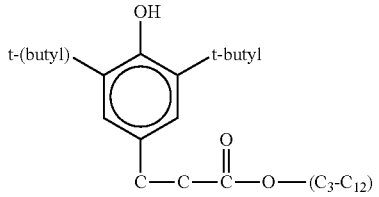

Phenolic type antioxidants are well known in the lubricating industry and commercial examples such as Ethanox® 4710, Irganox® 1076, Irganox® L1035, Irganox® 1010, Irganox® L109, Irganox® L118, Irganox® L135 and the like are familiar to those skilled in the art. The above is presented only by way of exemplification, not limitation on the type of phenolic antioxidants which can be used.

The phenolic antioxidant may be incorporated in the composition in an amount in the range of 0.1 to 3 wt %, preferably 0.25 to 2.5 wt %, more preferably 0.5 to 2 wt % on an active ingredient basis.

Aromatic amine antioxidants include phenyl-α-naphthyl amine, which is described by the following molecular structure:

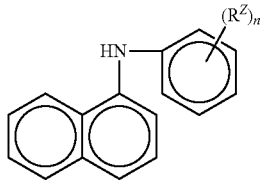

wherein $R^z$ is hydrogen or a $C_1$-$C_{14}$ linear or $C_3$-$C_{14}$ branched alkyl group, preferably $C_1$-$C_{10}$ linear or $C_3$-$C_{10}$ branched alkyl group, more preferably linear or branched $C_6$-$C_8$ and n is an integer ranging from 1 to 5 preferably 1. A particular example is Irganox L06.

Other aromatic amine antioxidants include other alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least 6 carbon atoms. Non-limiting examples of aliphatic groups include hexyl, heptyl, octyl, nonyl, and decyl. Generally, the aliphatic groups will not contain more than 14 carbon atoms. The general types of such other additional amine antioxidants which may be present include diphenylamines, phenothiazines, imidodibenzyls and diphenyl phenylene diamines Mixtures of two or more of such other additional aromatic amines may also be present. Polymeric amine antioxidants can also be used.

Another class of antioxidants which may be used in the lubricating oil compositions disclosed herein are oil-soluble copper compounds. Any oil-soluble suitable copper compound may be blended into the lubricating oil. Examples of suitable copper antioxidants include copper dihydrocarbyl thio- or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are known to be particularly useful.

Such antioxidants may be used individually or as mixtures of one or more types of antioxidants, with the total amount employed being an amount of 0.50 to 5 wt %, preferably 0.75 to 3 wt % (on an as-received basis).

Detergents

In addition to the alkali or alkaline earth metal salicylate detergent which is an optional component in the present disclosure, other detergents may also be present. While such other detergents can be present, it is preferred that the amount employed be such as to not interfere with the synergistic effect attributable to the presence of the salicylate. Therefore, most preferably such other detergents are not employed.

If such additional detergents are present, they can include alkali and alkaline earth metal phenates, sulfonates, carboxylates, phosphonates and mixtures thereof. These supplemental detergents can have total base number (TBN) ranging from neutral to highly overbased, i.e. TBN of 0 to over 500, preferably 2 to 400, more preferably 5 to 300, and they can be present either individually or in combination with each other in an amount in the range of from 0 to 10 wt %, preferably 0.5 to 5 wt % (active ingredient) based on the total weight of the formulated lubricating oil. As previously stated, however, it is preferred that such other detergent not be present in the formulation.

Such additional other detergents include by way of example and not limitation calcium phenates, calcium sulfonates, magnesium phenates, magnesium sulfonates and other related components (including borated detergents).

Sulfur Containing Compounds

Sulfur-containing compounds useful as additives in this disclosure include, for example, alkyl dithio carbamate, dialkyl dimercaptothiadiazole, other sulfur containing metal passivators, and combinations of any of the foregoing.

Dispersants

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines Molar ratios can vary depending on the amine or polyamine. For example, the molar ratio of alkenyl succinic anhydride to TEPA can vary from 1:1 to 5:1.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine.

The molecular weight of the alkenyl succinic anhydrides will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from 0.1 to 5 moles of boron per mole of dispersant reaction product.

Mannich base dispersants are made from the reaction of alkylphenols, formaldehyde, and amines. Process aids and catalysts, such as oleic acid and sulfonic acids, can also be part of the reaction mixture. Molecular weights of the alkylphenols range from 800 to 2,500 or more.

Typical high molecular weight aliphatic acid modified Mannich condensation products can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamine reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this disclosure include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5000 or more or a mixture of such hydrocarbylene groups. Other preferred dispersants include succinic acid-esters and amides, alkylphenol-polyamine-coupled Mannich adducts, their capped derivatives, and other related components. Such additives may be used in an amount of 0.1 to 20 wt %, preferably 0.1 to 8 wt %, more preferably 1 to 6 wt % (on an as-received basis) based on the weight of the total lubricant.

Pour Point Depressants

Conventional pour point depressants (also known as lube oil flow improvers) may also be present. Pour point depressant may be added to lower the minimum temperature at which the fluid will flow or can be poured. Non-limiting examples of suitable pour point depressants include alkylated naphthalenes polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. Such additives may be used in amount of 0.0 to 0.5 wt %, preferably 0 to 0.3 wt %, more preferably 0.001 to 0.1 wt % on an as-received basis.

Corrosion Inhibitors/Metal Deactivators

Corrosion inhibitors are used to reduce the degradation of metallic parts that are in contact with the lubricating oil composition. Suitable corrosion inhibitors include aryl thiazines, alkyl substituted dimercapto thiodiazoles thiadiazoles and mixtures thereof. Such additives may be used in an amount of 0.01 to 5 wt %, preferably 0.01 to 1.5 wt %, more preferably 0.01 to 0.2 wt %, still more preferably 0.01 to 0.1 wt % (on an as-received basis) based on the total weight of the lubricating oil composition.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride and sulfolane-type seal swell agents such as Lubrizol 730-type seal swell additives. Such additives may be used in an amount of 0.01 to 3 wt %, preferably 0.01 to 2 wt % on an as-received basis.

Corrosion Inhibitors and Antirust Additives

Anti-rust additives (or corrosion inhibitors) are additives that protect lubricated metal surfaces against chemical attack by water or other contaminants. One type of anti-rust additive is a polar compound that wets the metal surface preferentially, protecting it with a film of oil. Another type of anti-rust additive absorbs water by incorporating it in a water-in-oil emulsion so that only the oil touches the surface. Yet another type of anti-rust additive chemically adheres to the metal to produce a non-reactive surface. Examples of suitable additives include zinc dithiophosphates, metal phenolates, basic metal sulfonates, fatty acids and amines. Such additives may be used in an amount of 0.01 to 5 wt %, preferably 0.01 to 1.5 wt % on an as-received basis.

In addition to the ZDDP anti-wear additives, other anti-wear additives can be present, including zinc dithiocarbamates, molybdenum dialkyldithiophosphates, molybdenum dithiocarbamates, other organo molybdenum-nitrogen complexes, sulfurized olefins, etc.

The term "organo molybdenum-nitrogen complexes" embraces the organo molybdenum-nitrogen complexes described in U.S. Pat. No. 4,889,647. The complexes are reaction products of a fatty oil, dithanolamine and a molybdenum source. Specific chemical structures have not been assigned to the complexes. U.S. Pat. No. 4,889,647 reports an infrared spectrum for a typical reaction product of that invention; the spectrum identifies an ester carbonyl band at 1740 $cm^{-1}$ and an amide carbonyl band at 1620 $cm^{-1}$. The fatty oils are glyceryl esters of higher fatty acids containing at least 12 carbon atoms up to 22 carbon atoms or more. The molybdenum source is an oxygen-containing compound such as ammonium molybdates, molybdenum oxides and mixtures.

Other organo molybdenum complexes which can be used in the present disclosure are tri-nuclear molybdenum-sulfur compounds described in EP 1 040 115 and WO 99/31113 and the molybdenum complexes described in U.S. Pat. No. 4,978,464.

In the above detailed description, the specific embodiments of this disclosure have been described in connection with its preferred embodiments. However, to the extent that the above description is specific to a particular embodiment or a particular use of this disclosure, this is intended to be illustrative only and merely provides a concise description of the exemplary embodiments. Accordingly, the disclosure is not limited to the specific embodiments described above; but, rather, the disclosure includes all alternatives, modifications, and equivalents falling within the true scope of the appended claims. Various modifications and variations of this disclosure will be obvious to a worker skilled in the art and it is to be understood that such modifications and variations are to be included within the purview of this application and the spirit and scope of the claims. The following are examples of the present disclosure and are not to be construed as limiting.

EXAMPLES

A rotary screw air compressor was used to provide a severe operating test environment for some of the examples (B-F) in the testing set forth below. Operating temperatures were 130° C., which is 40-50° C. above where typical air compressors would operate. Air compressors provide test conditions high in oxygen, along with other atmospheric substances, as the fluid is in constant contact with its surrounding environment. Air compressors also represent a good example of industrial equipment in use, because they are found in large numbers throughout different industries around the globe.

The testing consisted of charging the compressor with the test fluid and taking small samples at timed intervals. Inspection properties included total acid number (TAN) and viscosity. Some examples (A-B, G-M) were tested for oxidation performance according to the method set forth earlier in the disclosure.

The compositions which were subject to the testing and the results obtained are set forth in the following table. Examples C, H and I are comparative examples; examples A-B, D-G and J-M are in accordance with the disclosure. As can be seen from the results set forth in the table, the oxidation performance of the examples in accordance with the disclosure showed significantly better performance than the comparative examples not in accordance with the disclosure. For the additives shown in the table below, no diluents were used with the exception of the defoamant/demulsifier and rust/corrosion inhibitors, which included diluents (kerosene and/or mineral oil).

| | Examples | | | | | | | | | | | | |
|---|---|---|---|---|---|---|---|---|---|---|---|---|---|
| | A | B | C | D | E | F | G | H | I | J | K | L | M |
| ISO VG | 32 | 32 | 68 | 68 | 68 | 68 | 100 | 220 | 220 | 220 | 220 | 220 | 460 |
| Alkylated Naphthalene, wt. % | 97.92 | 70.20 | 18.00 | 65.00 | 70.30 | 70.30 | 97.92 | 23.00 | 23.00 | 60.00 | 60.00 | 60.00 | 60.00 |
| Polyalphaolefin, wt. % | | 27.79 | 78.32 | 31.79 | 27.89 | 27.89 | | 74.92 | 74.52 | 37.42 | 37.42 | 36.16 | 36.66 |
| Alkylated Diarylamine, wt. % | 0.67 | — | 1.00 | 1.00 | 0.67 | 0.67 | 0.67 | — | — | 0.67 | 0.67 | — | — |

-continued

| | Examples | | | | | | | | | | | | |
|---|---|---|---|---|---|---|---|---|---|---|---|---|---|
| | A | B | C | D | E | F | G | H | I | J | K | L | M |
| Alkylated Phenyl Naphthylamine, wt. % | — | 0.67 | — | — | — | — | — | 0.75 | 0.75 | 0.67 | 0.67 | 1.50 | 1.50 |
| Dialkyl Dithiocarbamate, wt. % | 0.33 | 0.33 | — | — | 0.33 | 0.33 | 0.33 | — | — | — | 0.16 | — | — |
| Dialkyl Dimercapto-benzothiadiazole, wt. % | — | 0.06 | — | 0.06 | 0.06 | 0.06 | — | — | — | 0.16 | — | 0.16 | 0.16 |
| Phenolic Antioxidant, wt. % | — | — | 0.75 | 0.75 | — | — | — | — | — | — | — | — | — |
| EP/Antiwear, wt. % | 0.75 | 0.45 | 1.50 | 1.00 | 0.45 | 0.45 | 0.75 | 1.00 | 0.70 | 0.75 | 0.75 | 0.75 | 0.75 |
| Non Sulfur Containing Metal Passivator, wt. % | 0.03 | — | — | — | — | — | 0.03 | 0.03 | 0.03 | 0.03 | 0.03 | 0.03 | 0.03 |
| Rust/Corrosion Inhibitors, wt. % | 0.20 | 0.30 | 0.23 | 0.20 | 0.30 | 0.30 | 0.20 | 0.20 | 0.30 | 0.20 | 0.20 | 0.30 | 0.30 |
| Defoamant/ Demulsifier, wt. % | 0.10 | 0.20 | 0.20 | 0.20 | — | — | 0.10 | 0.10 | 0.70 | 0.10 | 0.10 | 1.10 | 0.60 |
| Formulation Sum | 100 | 100 | 100 | 100 | 100 | 100 | 100 | 100 | 100 | 100 | 100 | 100 | 100 |
| 100 C. Kinematic Viscosity, cSt | 4.8 | 5.4 | 10.6 | — | 9.6 | 9.2 | 13.5 | 25.1 | 26.9 | 25.0 | 25.0 | 23.9 | 44.2 |
| 40 C. Kinematic Viscosity, cSt | 29 | 32 | 70 | 61 | 71 | 71 | 120 | 216 | 203 | 218 | 218 | 207 | 446 |
| Compressor 130 C., Hours to Failure | — | >2200 | 740 | 1230 | 1400 | 1550 | — | — | — | — | — | — | — |
| High Temperature Oxidation 170 C., Hours to Failure | 409 | >400 | — | — | — | — | 234 | 51 | 68 | 254 | 244 | 218 | 217 |

The kinematic viscosities of the PAO fluids and of the alkylated naphthalene fluids which may also be used in the above inventive Examples are shown in the respective tables below.

| Polyalphaolefin | Kinematic Viscosity, mm2/s | | | | | | | | | |
|---|---|---|---|---|---|---|---|---|---|---|
| 100 C. | 3.9 | 5.3 | 7.8 | 9.9 | 40.2 | 111 | 150 | 155 | 300 | 1000 |
| 40 C. | 17 | 27 | 47 | 69 | 404 | 1,390 | 1,500 | 1,700 | 3,100 | 10,000 |

| Alkylated Naphthalene | Kinematic Viscosity, mm2/s | | | | | | |
|---|---|---|---|---|---|---|---|
| 100 C. | 4.6 | 5.4 | 8.9 | 12.6 | 12.8 | 18.5 | 20.8 |
| 40 C. | 27 | 36 | 72 | 116 | 124 | 175 | 205 |

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted. When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains. The present disclosure has been described above with reference to numerous embodiments and specific examples. Many variations will suggest themselves to those skilled in this art in light of the above detailed description. All such obvious variations are within the full intended scope of the appended claims.

PCT and EP Clauses

1. A lubricating composition comprising in admixture:

at least 55 wt % of a base oil component comprised of alkylated aromatic;

from 0 wt % to 45 wt % of a base oil of API Group II, Group III or Group IV, and combinations of any of the foregoing, based on the total weight of the admixed components that are used to produce the lubricating composition; and an additive combination comprised of alkylated diarylamine, non-alkylated diarylamine and combinations thereof and a sulfur-containing metal passivator, wherein the amount of base oil other than alkylated naphthalene, alkylated benzene and, if present, API Group II, Group III or Group IV, is less than 10 wt % based on the total weight of the admixed components that comprise the lubricating composition.

2. The lubricating composition of clause 1, wherein the base oil component comprising the alkylated aromatic is selected from alkylated naphthalene, alkylated benzene and combinations thereof.

3. The lubricating composition of clause 2, wherein the amount of base oil component selected from alkylated naphthalene, alkylated benzene and combinations thereof is from 55 wt % to 90 wt % of the lubricant composition.

4. The lubricating composition of clauses 1-3, wherein the amount of base oil component selected from API Group II, Group III, Group IV, ethylene copolymers and combinations of any of the foregoing is from 5 wt % to 40 wt %.

5. The lubricating composition of clauses 2-4, wherein the amount of base oil other than alkylated naphthalene, alkylated benzene and, if present, API Group II, Group III, Group IV and ethylene copolymer, is less than 5 wt %, based on the total weight of the admixed components that comprise the lubricating composition.

6. The lubricating composition of clauses 1-5, wherein the ratio of the alkylated diarylamine, non-alkylated diarylamine and combinations thereof to the sulfur-containing metal passivator is from 1:1 to 20:1.

7. The lubricating composition of clauses 1-6, wherein the amount of each of each of the alkylated or non-alkylated diarylamine and sulfur-containing metal passivator is from 0.05 wt % to 2 wt %, based on the total weight of the admixed components that comprise the lubricating composition.

8. The lubricating composition of clauses 1-7, wherein the alkylated diarylamine is comprised of mixed alkylated diaryl amine.

9. The lubricating composition of clause 8, wherein the mixed alkylated diaryl amine is selected from alkylated diphenylamine, alkylated phenyl naphthylamine and combinations thereof.

10. The lubricating composition of clauses 1-9, wherein the sulfur-containing metal passivator is selected from dialkyl dithio carbamate, dialkyl dimercaptothiadiazole and combinations thereof.

11. The lubricating composition of clauses 1-10, wherein the sulfur-containing metal passivator is ashless and substantially metal free.

12. The lubricating composition of clauses 1-11, wherein the sulfur-containing metal passivator is substantially free of molybdenum.

13. A method of producing a lubricating composition comprising:

blending at least 55 wt % of a base oil component comprised of alkylated aromatic, and from 0 wt % to 45 wt % of a base oil component selected from API Group II, Group III, Group IV, ethylene copolymers and combinations thereof, based on the total weight of the admixed components that are used to produce the lubricating composition, with an additive composition comprised of alkylated diarylamine, non-alkylated diarylamine and combinations thereof and a sulfur-containing metal passivator, wherein the amount of base oil other than alkylated aromatic and, if present, API Group II, Group III, Group IV and/or ethylene copolymer, is less than 10 wt % based on the total weight of the admixed components that comprise the lubricating composition.

14. The method of clause 13, wherein the base oil component comprising the alkylated aromatic is selected from alkylated naphthalene, alkylated benzene and combinations of any of the foregoing.

15. The method of clauses 13-14, wherein the base oil components and additive composition are blended together at substantially the same time.

16. The method of clauses 13-15, wherein the additive composition is blended into the base oil component selected from the group consisting of alkylated naphthalene, alkylated benzene and combinations thereof, and thereafter the remaining base oil component, if any, is added thereto.

17. An additive composition for a base oil lubricating composition, said additive comprised of alkylated diarylamine, non-alkylated diarylamine and combinations thereof and a sulfur-containing metal passivator, wherein the ratio of the alkylated diarylamine, non-alkylated diarylamine and combinations thereof to the sulfur-containing metal passivator is from 1:1 to 20:1.

18. A method of improving the oxidation resistance of a base oil lubricant composition comprising at least 55 wt % of a base oil component comprised of alkylated aromatic, and from 0 wt % to 45 wt % of a base oil component selected from API Group II, Group III, Group IV, ethylene copolymers and combinations of any of the foregoing, based on the total weight of the admixed components that are used to produce the lubricating composition, said method comprising adding to the lubricant composition an additive comprised of alkylated diarylamine, non-alkylated diarylamine and combinations thereof and a sulfur-containing metal passivator, wherein the ratio of the amine component to sulfur component is from 1:1 to 20:1.

19. The method of clause 18, wherein the alkylated aromatic is selected from alkylated naphthalene, alkylated benzene and combinations thereof.

What is claimed is:

1. A lubricating composition comprising in admixture:

at from 60 wt % to 75 wt % of a base oil component comprised of alkylated napthalene, from 27.79 wt % to 37.42 wt % of a base oil of API Group IV comprising PAO, based on the total weight of the admixed components that are used to produce the lubricating composition, and an additive combination comprised of 0.67 to 1.5 wt. % of alkylated diarylamine, and a sulfur-containing metal passivator selected from 0.16 to 0.33 wt. % of dialkyl dithiocarbamate, about 0.16 wt. % of dialkyl dimercaptobenzothiadiazole and a combination of about 0.33 wt. % of dialkyl dithiocarbamate and about 0.06 wt. % of dialkyl dimercaptobenzothiadiazole, wherein additional base oil other than alkylated naphthalene and Group IV is additive diluent oil, wherein the ISO viscosity grade (VG) of the lubricating composition ranges from 68 to 460.

2. The lubricating composition of claim 1, wherein the amount of alkylated naphthalene is from 60 wt % to 70.3 wt % of the lubricant composition.

3. The lubricating composition of claim 1, wherein the amount of base oil other than alkylated naphthalene and Group IV from additive diluent oil is from 1 wt % to 2 wt %, based on the total weight of the admixed components that comprise the lubricating composition.

4. The lubricating composition of claim 1, wherein the ratio of the alkylated diarylamine to the sulfur-containing metal passivator is from 2:1 to 10:1.

5. The lubricating composition of claim 1, wherein the alkylated diarylamine is comprised of mixed alkylated diaryl amine.

6. The lubricating composition of claim 5, wherein the mixed alkylated diaryl amine is selected from alkylated diphenylamine, alkylated phenyl naphthylamine and combinations thereof.

7. The lubricating composition of claim 1, wherein the sulfur-containing metal passivator is ashless and substantially metal free.

8. The lubricating composition of claim 7, wherein the sulfur-containing metal passivator is substantially free of molybdenum.

9. A method of producing a lubricating composition comprising:

blending at from 60 wt % to 75 wt % of a base oil component comprised of alkylated napthalene, from 27.79 wt % to 37.42 wt % of a base oil of API Group IV comprising PAO, based on the total weight of the admixed components that are used to produce the lubricating composition, and an additive combination comprised of 0.67 to 1.5 wt. % of alkylated diarylamine, and a sulfur-containing metal passivator selected from 0.16 to 0.33 wt. % of dialkyl dithiocarbamate, about 0.16 wt. % of dialkyl dimercaptobenzothiadiazole and a combination of about 0.33 wt. % of dialkyl dithiocarbamate and about 0.06 wt. % of dialkyl dimercaptobenzothiadiazole, wherein additional base oil other than alkylated naphthalene and Group IV is additive diluent oil, wherein the ISO viscosity grade (VG) of the lubricating composition ranges from 68 to 460.

10. The method of claim 9, wherein the base oil components and additive composition are blended together at substantially the same time.

11. The method of claim 9, wherein the additive composition is blended into the alkylated naphthalene, and thereafter the remaining base oil component is added thereto.

12. A method of improving the oxidation resistance of a base oil lubricant composition comprising providing a lubricant composition comprising at from 60 wt % to 75 wt % of a base oil component comprised of alkylated napthalene, from 27.79 wt % to 37.42 wt % of a base oil of API Group IV comprising PAO, based on the total weight of the admixed components that are used to produce the lubricating composition, and an additive combination comprised of 0.67 to 1.5 wt. % of alkylated diarylamine, and a sulfur-containing metal passivator selected from 0.16 to 0.33 wt. % of dialkyl dithiocarbamate, about 0.16 wt. % of dialkyl dimercaptobenzothiadiazole and a combination of about 0.33 wt. % of dialkyl dithiocarbamate and about 0.06 wt. % of dialkyl dimercaptobenzothiadiazole, wherein additional base oil other than alkylated naphthalene and Group IV is additive diluent oil, wherein the ISO viscosity grade (VG) of the lubricating composition ranges from 68 to 460.

* * * * *